US007686193B1

(12) United States Patent
Gervais et al.

(10) Patent No.: US 7,686,193 B1
(45) Date of Patent: Mar. 30, 2010

(54) MECHANICAL ACTUATOR FOR AEROSOL CAN

(76) Inventors: George Gervais, 3300 N. State Road 7, Hollywood, FL (US) 33021; Michael Anthony, 10189 W. Sample Rd., Coral Springs, FL (US) 33065

( * ) Notice: Subject to any disclaimer, the term of this patent is extended or adjusted under 35 U.S.C. 154(b) by 472 days.

(21) Appl. No.: 11/786,807

(22) Filed: Apr. 13, 2007

(51) Int. Cl.
*A47G 19/00* (2006.01)

(52) U.S. Cl. ..... 222/402.15; 222/323; 222/473

(58) Field of Classification Search ..... 222/174, 222/323, 325, 402.13, 402.15, 473, 505, 222/509, 527; 239/282
See application file for complete search history.

(56) References Cited

U.S. PATENT DOCUMENTS 2,720,422 A 10/1955 Mercur
3,017,056 A 1/1962 Bishop
3,045,878 A * 7/1962 Blanford et al. ..... 222/473
3,069,095 A * 12/1962 Bishop ..... 239/280.5
3,549,055 A * 12/1970 Gatland ..... 222/182
4,023,711 A 5/1977 Sena
4,040,543 A 8/1977 Guillen
4,089,440 A 5/1978 Lee
4,579,258 A * 4/1986 Brown et al. ..... 222/323
5,518,148 A 5/1996 Smrt
5,904,273 A 5/1999 Aspacher
6,016,938 A * 1/2000 Eichorst ..... 222/402.15
6,364,177 B1 * 4/2002 Taylor ..... 222/473
6,450,423 B1 9/2002 Gurule

* cited by examiner

*Primary Examiner*—Kevin P Shaver
*Assistant Examiner*—Andrew P Bainbridge
(74) *Attorney, Agent, or Firm*—Malin Haley DiMaggio Bowen & Lhota, P.A.; Mark D. Bowen, Esq.

(57) ABSTRACT

A mechanical actuator for attachment to a conventional aerosol can to allow for holding the can with a comfortable handle and controlled dispensing of substances, such as spray paint, using a trigger-type actuator. The device further includes a quick can loading and unloading system including a resilient band that facilitates rapid hands free unloading and one hand loading of aerosol cans. A manual actuator is provided to selectively stretch the band to facilitate loading (and unloading) of aerosol cans. Relaxing the manual actuator allows the resilient band move into constricted engagement with the can.

7 Claims, 8 Drawing Sheets

MECHANICAL ACTUATOR FOR AEROSOL CAN

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to mechanical devices for use with aerosol spray cans. More particularly, the present invention relates to an extendable mechanical actuator for use with conventional aerosol spray cans to enable an operator to spray substances, such as paint, in high or difficult to reach areas without the use of a ladder.

2. Description of Related Art

The use of cans of aerosol cans to apply substances, such as paint, bug spray, and a host of other substances to a wide variety of objects is well known. Aerosol spray cans typically provide pressure vessels for containing a mixture of a substance and a compressed gas. The cans provide convenient packaging for applying the contents to a surface or object in a directed manner. The cans typically include a top adapted with a button having a nozzle that functions to emit a spray when the button is manually actuated by depressing the button downward. Aerosol cans are typically hand-held and manipulated by the user while applying a substance, such as spray paint, to any given surface or structure.

One limitation present in the application of substances from aerosol spray cans relates to the difficulty of applying the substances to areas out of the user's immediate reach, such as high areas. Another limitation relates to difficulties experienced by people in attempting to actuate and control the dispensing button. Accordingly, there exists a need for an extension tool adapted for use with aerosol spray cans to facilitate application of substances to difficult to reach areas.

BRIEF SUMMARY OF THE INVENTION

The present invention provides a mechanical device for attachment to a conventional aerosol can to allow for holding the can with a comfortable handle and controlled dispensing of substances, such as spray paint, using a trigger-type actuator. The device further includes a quick can loading and unloading system incorporating a resilient band. A finger actuated lever is provided to selectively radially stretch the band to facilitate loading (and unloading) of aerosol cans. Relaxing the finger actuated lever allows the resilient band move into constricted engagement with the can.

Accordingly, it is an object of the present invention to provide a mechanical actuator for use with conventional aerosol cans.

Another object of the present invention is to provide such a mechanical actuator adapted for rapid attachment and detachment of an aerosol can.

Yet another object of the present invention is to provide a mechanical actuator that is attachable to a conventional aerosol without requiring modification of the can or significant adjustment of the mechanical actuator.

In accordance with these and other objects, which will become apparent hereinafter, the instant invention will now be described with particular reference to the accompanying drawings.

DETAILED DESCRIPTION OF THE INVENTION

Figure 1:
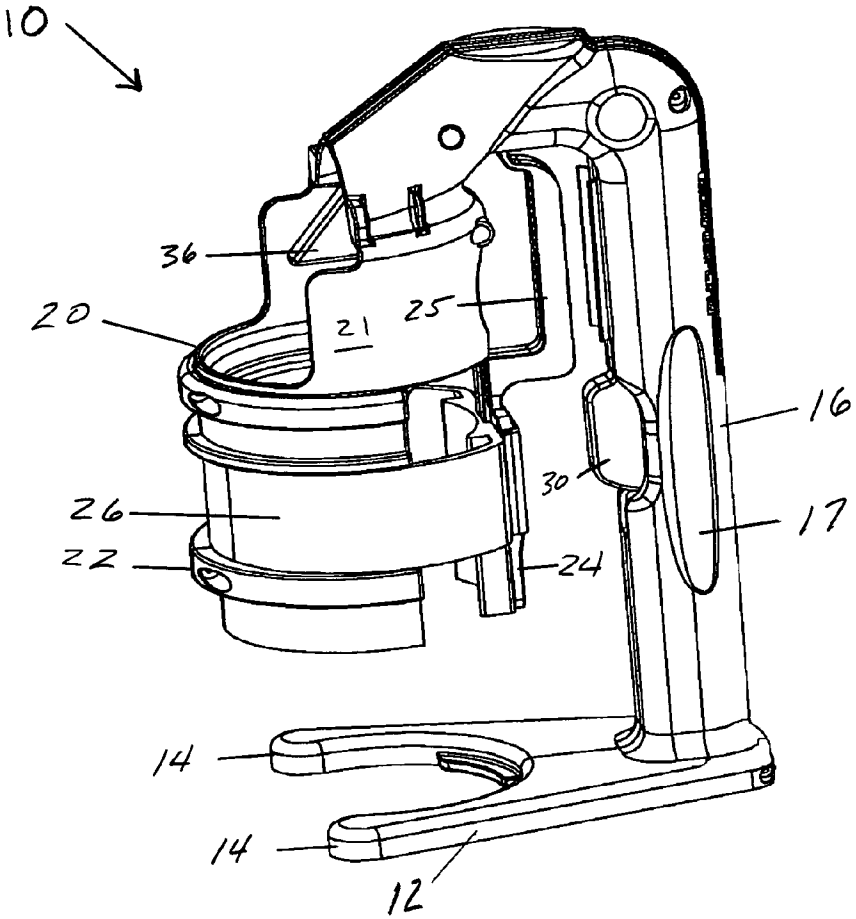
FIG. 1 is a perspective view of a mechanical actuator in accordance with the present invention.
Figure 2:
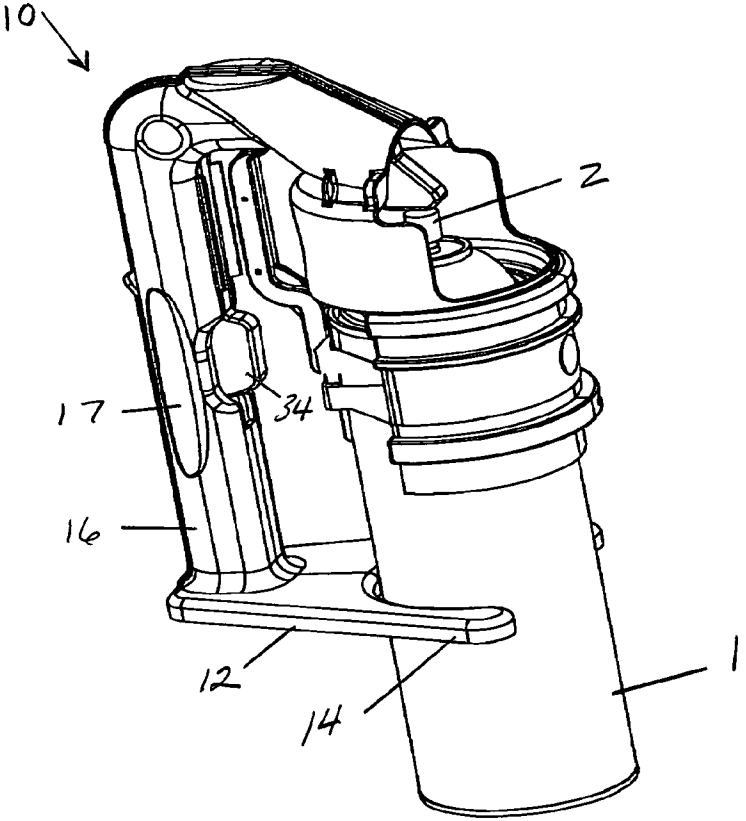
FIG. 2 is a perspective view of the actuator attached to an aerosol can.
Figure 3:
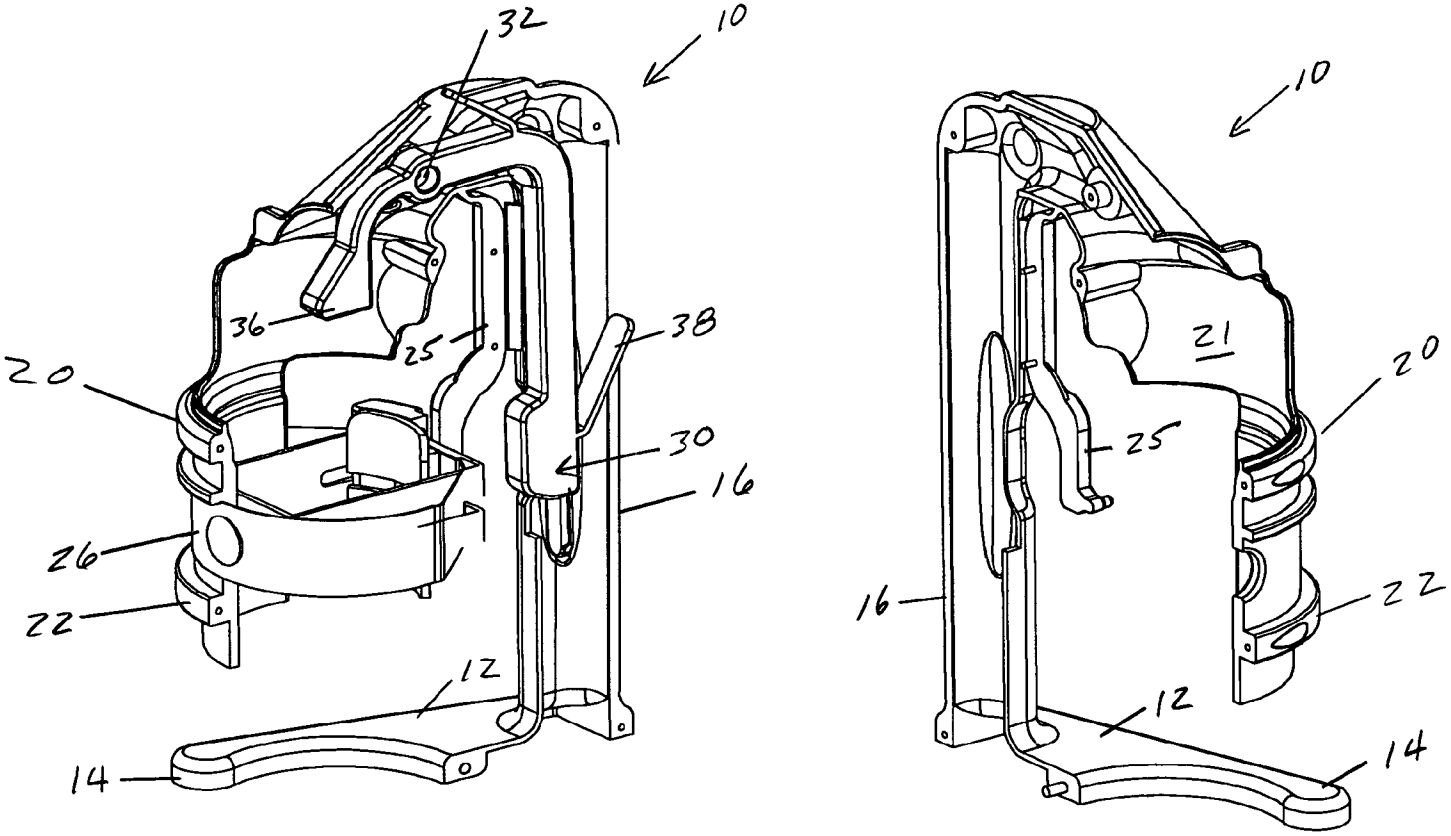
FIG. 3 is an exploded perspective view of the actuator split into left and right halves.
Figure 4:
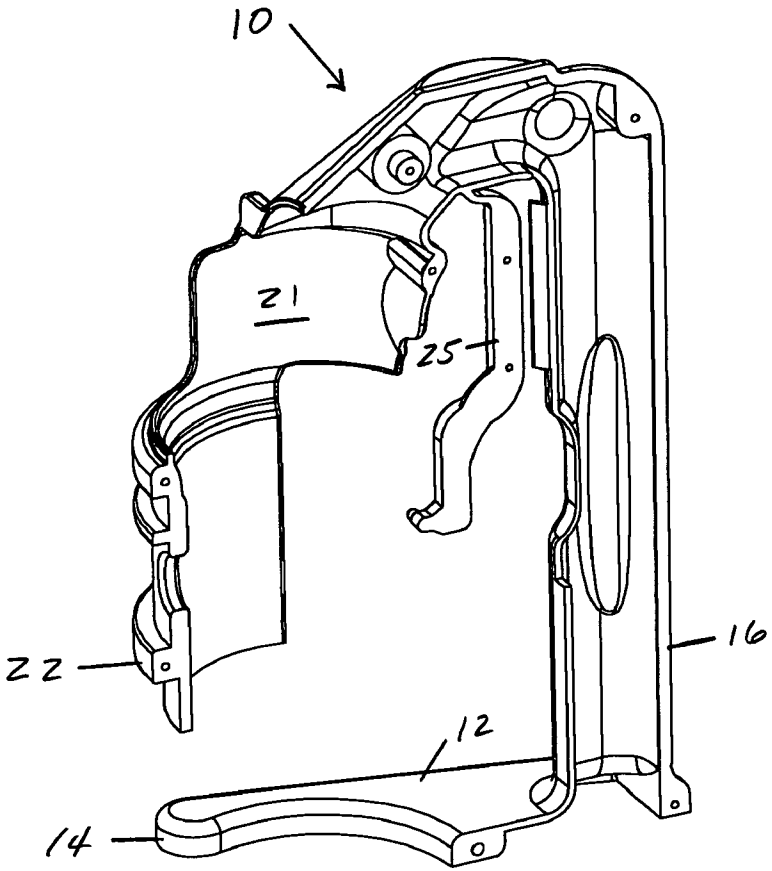
FIG. 4 is a perspective view of the right half thereof.
Figure 5:
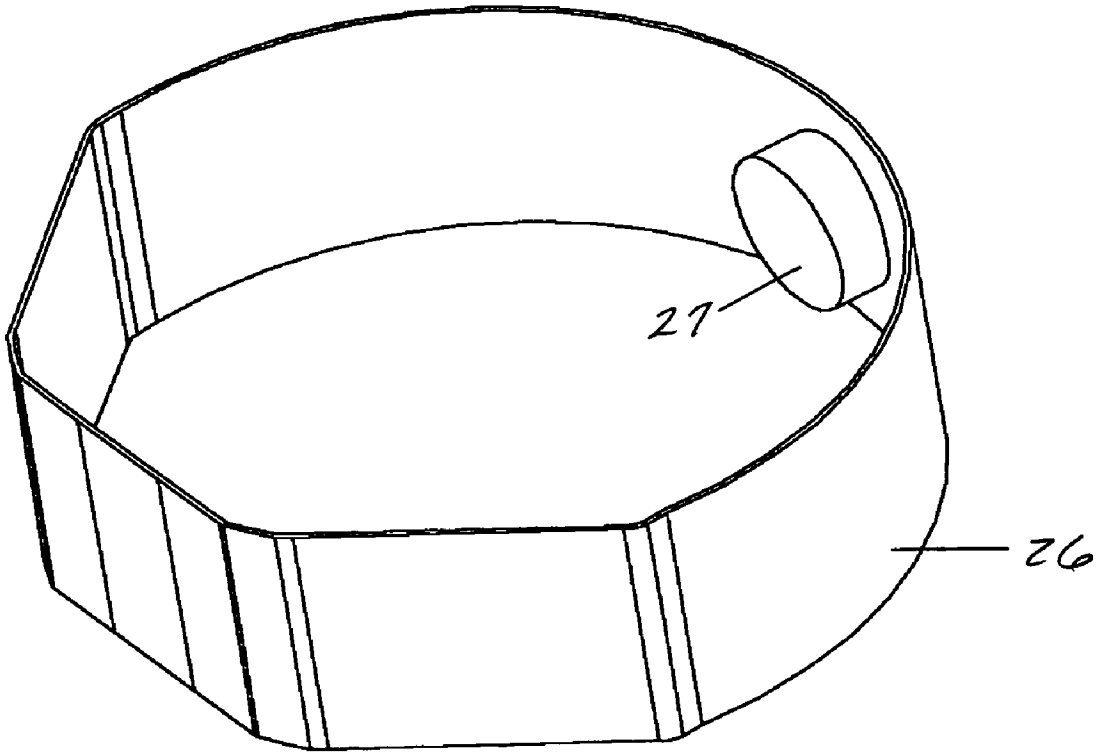
FIG. 5 is a perspective view of the resilient can attachment member.
Figure 6:
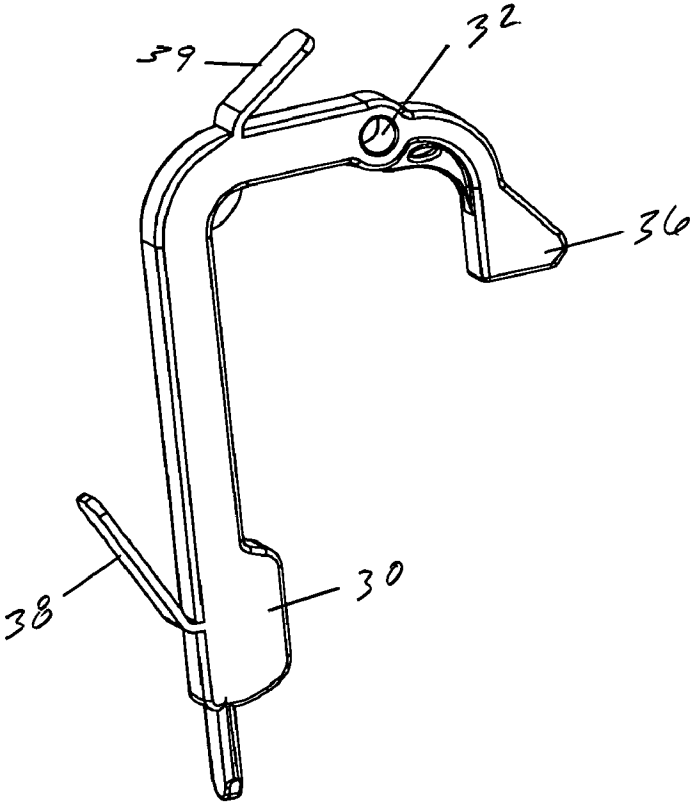
FIG. 6 is a perspective view of the trigger mechanism for actuating the spray button of an aerosol can.
Figure 7:
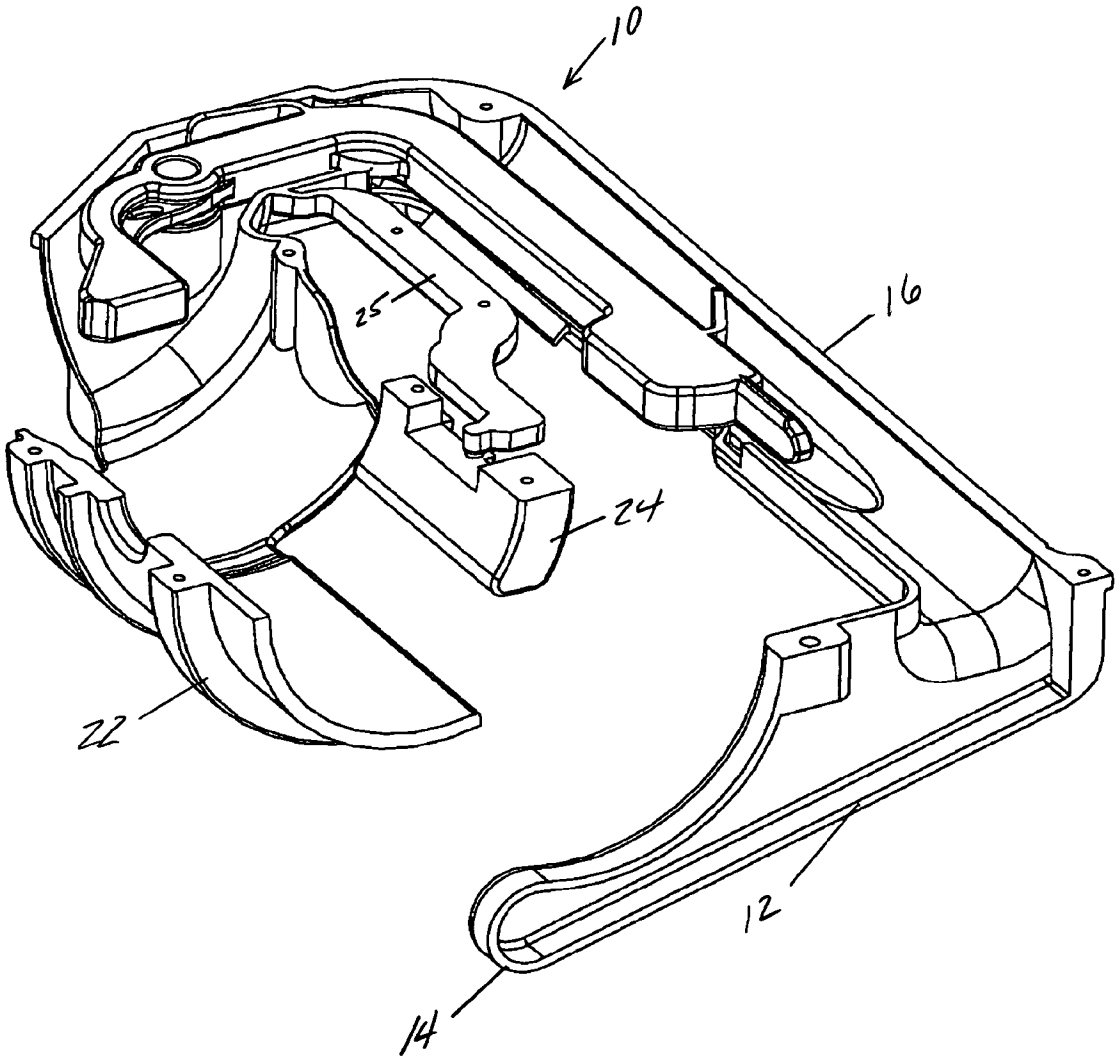
FIG. 7 is a perspective view of the actuator right half.
Figure 8:
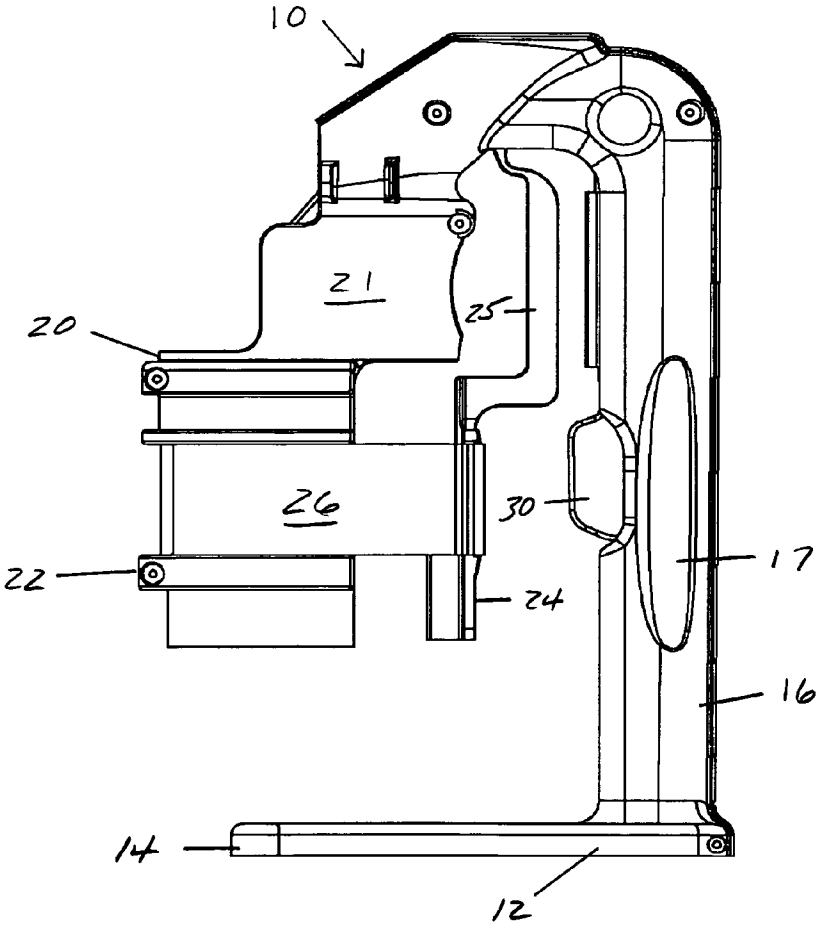
FIG. 8 is a side view of the mechanical actuator.

With reference now to the drawings, FIGS. 1-8 depict a preferred embodiment of a mechanical actuator, generally referenced as 10, for use aerosol spray cans. FIG. 1 depicts mechanical actuator 10 in a standalone configuration without an aerosol spray can attached thereto. FIG. 2 depicts mechanical actuator 10 in an operative relation with an aerosol can, referenced as 1, mounted to mechanical actuator 10. Aerosol can 1 includes a spray button, referenced as 2, disposed thereon such that actuation of button 2 functions to spray the contents of the can. Mechanical actuator 10 includes a base 12 that functions to enable actuator 10 to be free standing. Base 12 includes elongate opposing horizontal feet 14, sized and shaped for mating engagement with a cylindrical aerosol can so as to stabilize a can disposed there between. FIG. 2 illustrates installation of can 1 onto mechanical actuator 10. Mechanical actuator 10 further includes a vertical handle 16 connected to a can mounting portion 20.

As significant aspect of the present invention involves providing a mechanical actuator having a can mount adapted for rapid loading and unloading of aerosol cans. Accordingly, the present invention is adapted with a can mount having a rapid loading and unloading system, generally referenced as 20, that allows the user to unload aerosol cans virtually hands free (e.g. without having to touch the can) and to facilitate single handed loading. More particularly, can loading and unloading system 20 includes: an upper portion defining a spray shield 21; and a lower portion including a semi-cylindrical can receiving structure including a first semi-cylindrical portion 22 fixed relative to body 16 and a second semi-cylindrical portion 24 in movable relation therewith. Second semi-cylindrical portion 24 further includes a finger actuated lever 25 movably connected thereto to allow the user to selectively radially enlarge or open can mounting portion 20 by drawing lever 25 toward body 16. Can mounting portion 20 further includes a resilient band member 26 in surrounding relation with first and second semi-cylindrical portions. Resilient band member 26 biases can mounting portion 20, and particularly first and second semi-cylindrical portions radially inward to a radially compressed or closed configuration. Band 26 further includes an inner surface having a radially inwardly projecting button 27 that is insertably received within an aperture formed in first semi-cylindrical portion 22 for engaging the outer surface of aerosol container 1.

As should be apparent the user may insert an aerosol can by grasping mechanical actuator 10 and moving lever 25, with his fingers, such that second semi-cylindrical portion 24 of the can mount portion moves radially outward to a radially expanded configuration relative to first semi-cylindrical portion 22 against the biasing force of resilient band 26. Next the user simply inserts a can into operative position (using only one hand) and releases lever 25 whereby resilient band member 26 causes first and second semi-cylindrical portions, 22 and 24, to constrict into press fit engagement with can 1 as best seen in FIG. 2. First and second semi-cylindrical portions, 22 and 24, preferably are adapted with rubberized type engagement surfaces to maintain aerosol container 1 in secured slip resistant engagement. In a preferred embodiment, first semi-cylindrical portion 22 is adapted with an aperture to allow projecting resilient button 27 on band 26 to project therethrough for engaging the front outer surface of the can. In an alternate embodiment, the can mount may be adapted with resilient pads for engaging the surface of the can.

Handle 16 includes a contoured portion 17 shaped for ease of gripping, and a pivotally connected trigger assembly 30. Trigger assembly 30 is pivotally connected to handle 16 by a pivot connection, referenced as 32. Trigger assembly 30 includes a downwardly depending trigger-type member 34 positioned for manual actuation by the user's fingers, and a forwardly projecting spray actuator 36 adapted for engaging the top of the aerosol can dispensing button 2. Trigger assembly 30 is biased forward to a non-spraying or off configuration by resilient tabs 38 and 39 positioned to engage an inner surface of handle 16. As should be apparent, selective manual depression of trigger member 24 causes trigger assembly 20 to pivot about pivot connection 22 thus resulting in downward movement of spray actuator 26. A further significant aspect of the present invention relates to providing trigger assembly 30 with a 3 to 1 mechanical advantage. Accordingly, the user is only required to apply to trigger 30 approximately ⅓ the force required to actuate spray button 2. Thus, if spray button 2 requires 3.0 pounds of force to actuate, then the user must apply 1.0 pound of force to trigger 30. This aspect of the invention is considered particularly significant in applications wherein extensive spraying is required, such as spray painting and disinfectant applications.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A hand-held apparatus for attachment to an aerosol spray can having a spray button for controlling sprayed application of a substance from the aerosol can, said apparatus comprising:

a main body having a handgrip for grasping by the user's hand;

said main body adapted with means for loading and unloading of an aerosol can, said means for loading and unloading including a generally cylindrical can mount configurable from an open configuration wherein the aerosol spray can may be loaded and unloaded to a closed configuration wherein a aerosol spray can is fixed relative to said main body;

said can mount resiliently biased to said closed configuration;

a lever disposed in spaced relation with said handgrip so as to enable the user to actuate said lever with the same hand that grasps the hand grip portion, said lever providing means for actuating said can mount from said closed configuration to said open configuration;

a trigger assembly pivotally connected to said main body, said trigger assembly adapted for causing said aerosol can to emit a spray upon manual actuation thereof; and said main body portion having a base to allow said main body to be free standing.

2. An apparatus according to claim 1, wherein said means for loading and unloading of an aerosol can includes a semi-cylindrical can receiving structure having a first semi-cylindrical portion fixed relative to said main body, a second semi-cylindrical portion in movable relation with said first semi-cylindrical portion and biased toward said first semi-cylindrical section by a resilient band.

3. An apparatus according to claim 1, further including a spray shield for preventing spray from said aerosol container from projecting rearward.

4. An apparatus for attachment to an aerosol spray can having a spray button for controlling sprayed application of a substance from the aerosol can, said apparatus comprising:

a main body having a handgrip for grasping by the user's hand;

said main body adapted with means for loading and unloading of an aerosol can, said means for loading and unloading including a generally cylindrical can mount configurable from an open configuration wherein the aerosol spray can may be loaded and unloaded to a closed configuration wherein a aerosol spray can is fixed relative to said main body;

said can mount resiliently biased to said closed configuration by a resilient band; a lever disposed generally between said can mount and said handgrip, said lever adapted to actuate said can mount from said closed configuration to said open configuration;

a trigger assembly pivotally connected to said main body, said trigger assembly adapted for causing said aerosol can to emit a spray upon manual actuation thereof; and said main body portion having a base to allow said main body to be free standing.

5. An apparatus according to claim 4, wherein said means for loading and unloading includes a can engaging structure having a first semi-cylindrical portion fixed relative to said main body and a second semi-cylindrical portion in movable relation with said first semi-cylindrical portion.

6. An apparatus according to claim 5, wherein said trigger assembly is configured to incorporate a mechanical advantage of approximately three to one, whereby application of one unit of force to said trigger results in application of three times said one unit of force to the aerosol can spray button.

7. An apparatus for attachment to an aerosol spray can having a spray button for controlling sprayed application of a substance from the aerosol can, said apparatus comprising:

a main body having a handgrip for grasping by the user's hand;

a generally cylindrical can mount having first and second semi-cylindrical members configurable between an open configuration wherein the aerosol spray can may be loaded and unloaded, and a closed configuration wherein a aerosol spray can is fixed relative to said main body;

said can mount resiliently biased to said closed configuration by a resilient band;

a lever associated with said handgrip and configured to actuate said can mount from said closed configuration to said open configuration;

a trigger assembly pivotally connected to said main body, said trigger assembly adapted for causing said aerosol can to emit a spray upon manual actuation thereof; and said main body portion having a base to allow said main body to be free standing.

* * * * *